US007025354B1

(12) United States Patent
Jones

(10) Patent No.: US 7,025,354 B1
(45) Date of Patent: Apr. 11, 2006

(54) CARD GAME

(76) Inventor: Jeffrey A. Jones, 108 Ash St., Lagrange, NC (US) 28551

( * ) Notice: Subject to any disclaimer, the term of this patent is extended or adjusted under 35 U.S.C. 154(b) by 417 days.

(21) Appl. No.: 10/066,026

(22) Filed: Jan. 30, 2002

(51) Int. Cl.
*A63F 1/00* (2006.01)

(52) U.S. Cl. ..... 273/292; 273/139; 273/274; 463/17

(58) Field of Classification Search ..... 273/292, 273/274, 294, 142 E, 303, 138.1, 139, 142 R, 273/307, 269; 463/12–13
See application file for complete search history.

(56) References Cited

U.S. PATENT DOCUMENTS 5,398,938 A * 3/1995 Money ..... 463/61
5,540,442 A * 7/1996 Orselli et al. ..... 463/17
5,582,009 A * 12/1996 Brieschke ..... 60/560
5,713,573 A * 2/1998 Nazaryan ..... 273/292
5,772,211 A * 6/1998 Nazaryan et al. ..... 273/292
6,079,713 A * 6/2000 Paz ..... 273/292
6,550,772 B1 * 4/2003 Streeks et al. ..... 273/292
6,554,281 B1 * 4/2003 Flannery ..... 273/274
2002/0037765 A1 * 3/2002 Johnson ..... 463/17
2003/0171143 A1 * 9/2003 Valdez et al. ..... 463/16

* cited by examiner

*Primary Examiner*—Jessica Harrison
*Assistant Examiner*—Alex F. R. P. Rada, II
(74) *Attorney, Agent, or Firm*—Roy, Kiesel, Keegan & DeNicola

(57) ABSTRACT

A skinning card game. The game includes a marked playing surface, one or more standard decks of playing cards, a spinning wheel, and chips. The marked playing surface is provided with several identical player grids and a dealer grid. Each player and dealer grid contains a total of thirteen chip positioning spaces, one chip positioning space for each of the playing cards in each suit. Each grid may be arranged 4×3 array with a single space centered at the top of the array. Each chip positioning space is designated with a designation representing a playing card, such as for instance: A=ace, 1=one, 2=two, 3=three, 4=four, 5=five, 6=six, 7=seven, 8=eight, 9=nine, 10=ten, J=jack, Q=queen, and K=king. The spinning wheel has a spinnable pointer and thirteen card designation sections each designated in no particular order with the card values of ace, 1, 2, 3, 4, 5, 6, 7, 8, 9, 10, Jack, Queen, and King.

1 Claim, 1 Drawing Sheet

CARD GAME

TECHNICAL FIELD

The present invention relates to card games and more particularly to a card game that includes the steps of a) providing a marked playing surface, one or more standard decks of playing cards, a spinning wheel, and chips; the marked playing surface is provided with several identical player grids and a dealer grid, each player and dealer grid containing a total of thirteen chip positioning spaces, one chip positioning space for each of the playing cards in each suit, that are arranged 4×3 array with a single space centered at the top of the grid, each chip positioning space being designated with a designation representing a playing card, such as for instance: A=ace, 1=one, 2=two, 3=three, 4=four, 5=five, 6=six, 7=seven, 8=eight, 9=nine, 10=ten, J=jack, Q=queen, and K=king; the spinning wheel having a spinnable pointer and thirteen card designation sections each designated in no particular order with one of the card values of ace, 1, 2, 3, 4, 5, 6, 7, 8, 9, 10, Jack, Queen, and King; b) the one or more decks of playing cards are shuffled and placed in a shuffled card stack; c) the dealer spins the pointer to determine the house card, the house card being the card designated by the end of the pointer landing on a particular card designation sections; d) the dealer then places a chip or other marker over the chip positioning space for the house card on the dealer grid; e) each player then places a bet by selecting up to three separate card designation sections in their designated player grid by placing one or more chips over any chip positioning space except the chip positioning space corresponding to the house card, all chips positioned by a player on the player grid are considered to be bet; f) the dealer then pulls a match playing card from the shuffled card stack and turns the match playing card face up, the match playing card pulled is preferably selected by turning over the top card of the shuffled card stack; g) if the value of the match playing card corresponds to the house card, the house loses and pays each player an amount corresponding to the number of chips on that particular player's grid; if the value of the match playing card corresponds to a value selected by a player, the player loses any chips he/she may have placed on the corresponding chip positioning space of his/her players grid; h) each player is then given an opportunity to increase his/her existing wagers, no new number may be selected; i) play of the hand continues until the match playing card equals the house card or no more chips are positioned on any of the player grids; j) additional hands may be played by repeating steps c–g until fewer than a predetermined number of playing cards remain in the shuffled card stack in which case, step b) is performed prior to performing step c) for that particular hand. In one optional version, the deal rotates among the players. In addition, the match playing cards may be required to be left turned up until a predetermined number, such as four, have been dealt. The dealer is then able to pick up the used match playing cards and position them in a card holder for use when shuffling of the playing cards takes place.

BACKGROUND ART

Many individuals enjoy playing wagering card games. It would be a benefit, therefore to have a wagering card game that was exciting to play and simple to understand.

GENERAL SUMMARY DISCUSSION OF INVENTION

It is thus an object of the invention to provide a card game that includes the steps of a) providing a marked playing surface, one or more standard decks of playing cards, a spinning wheel, and chips; the marked playing surface is provided with several identical player grids and a dealer grid, each player and dealer grid containing a total of thirteen chip positioning spaces, one chip positioning space for each of the playing cards in each suit, that are arranged 4×3 array with a single space centered at the top of the grid, each chip positioning space being designated with a designation representing a playing card, such as for instance: A=ace, 1=one, 2=two, 3=three, 4=four, 5=five, 6=six, 7=seven, 8=eight, 9=nine, 10=ten, J=jack, Q=queen, and K=king; the spinning wheel having a spinnable pointer and thirteen card designation sections each designated in no particular order with one of the card values of ace, 1, 2, 3, 4, 5, 6, 7, 8, 9, 10, Jack, Queen, and King; b) the one or more decks of playing cards are shuffled and placed in a shuffled card stack; c) the dealer spins the pointer to determine the house card, the house card being the card designated by the end of the pointer landing on a particular card designation sections; d) the dealer then places a chip or other marker over the chip positioning space for the house card on the dealer grid; e) each player then places a bet by selecting up to three separate card designation sections in their designated player grid by placing one or more chips over any chip positioning space except the chip positioning space corresponding to the house card, all chips positioned by a player on the player grid are considered to be bet; f) the dealer then pulls a match playing card from the shuffled card stack and turns the match playing card face up, the match playing card pulled is preferably selected by turning over the top card of the shuffled card stack; g) if the value of the match playing card corresponds to the house card, the house loses and pays each player an amount corresponding to the number of chips on that particular player's grid; if the value of the match playing card corresponds to a value selected by a player, the player loses any chips he/she may have placed on the corresponding chip positioning space of his/her players grid; h) each player is then given an opportunity to increase his/her existing wagers, no new number may be selected; i) play of the hand continues until the match playing card equals the house card or no more chips are positioned on any of the player grids; j) additional hands may be played by repeating steps c–g until fewer than a predetermined number of playing cards remain in the shuffled card stack in which case, step b) is performed prior to performing step c) for that particular hand.

Accordingly, a card game is provided. The card game includes the steps of a) providing a marked playing surface, one or more standard decks of playing cards, a spinning wheel, and chips; the marked playing surface is provided with several identical player grids and a dealer grid, each player and dealer grid containing a total of thirteen chip positioning spaces, one chip positioning space for each of the playing cards in each suit, that are arranged 4×3 array with a single space centered at the top of the grid, each chip positioning space being designated with a designation representing a playing card, such as for instance: A=ace, 1=one, 2=two, 3=three, 4=four, 5=five, 6=six, 7=seven, 8=eight, 9=nine, 10=ten, J=jack, Q=queen, and K=king; the spinning wheel having a spinnable pointer and thirteen card designation sections each designated in no particular order with one of the card values of ace, 1, 2, 3, 4, 5, 6, 7, 8, 9, 10, Jack, Queen, and King; b) the one or more decks of playing cards are shuffled and placed in a shuffled card stack; c) the dealer spins the pointer to determine the house card, the house card being the card designated by the end of the pointer landing on a particular card designation sections; d) the dealer then places a chip or other marker over the chip positioning space for the house card on the dealer grid; e) each player then places a bet by selecting up to three separate card designation sections in their designated player grid by placing one or more chips over any chip positioning space except the chip positioning space corresponding to the house card, all chips positioned by a player on the player grid are considered to be bet; f) the dealer then pulls a match playing card from the shuffled card stack and turns the match playing card face up, the match playing card pulled is preferably selected by turning over the top card of the shuffled card stack; g) if the value of the match playing card corresponds to the house card, the house loses and pays each player an amount corresponding to the number of chips on that particular player's grid; if the value of the match playing card corresponds to a value selected by a player, the player loses any chips he/she may have placed on the corresponding chip positioning space of his/her players grid; h) each player is then given an opportunity to increase his/her existing wagers, no new number may be selected; i) play of the hand continues until the match playing card equals the house card or no more chips are positioned on any of the player grids; j) additional hands may be played by repeating steps c–g until fewer than a predetermined number of playing cards remain in the shuffled card stack in which case, step b) is performed prior to performing step c) for that particular hand.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
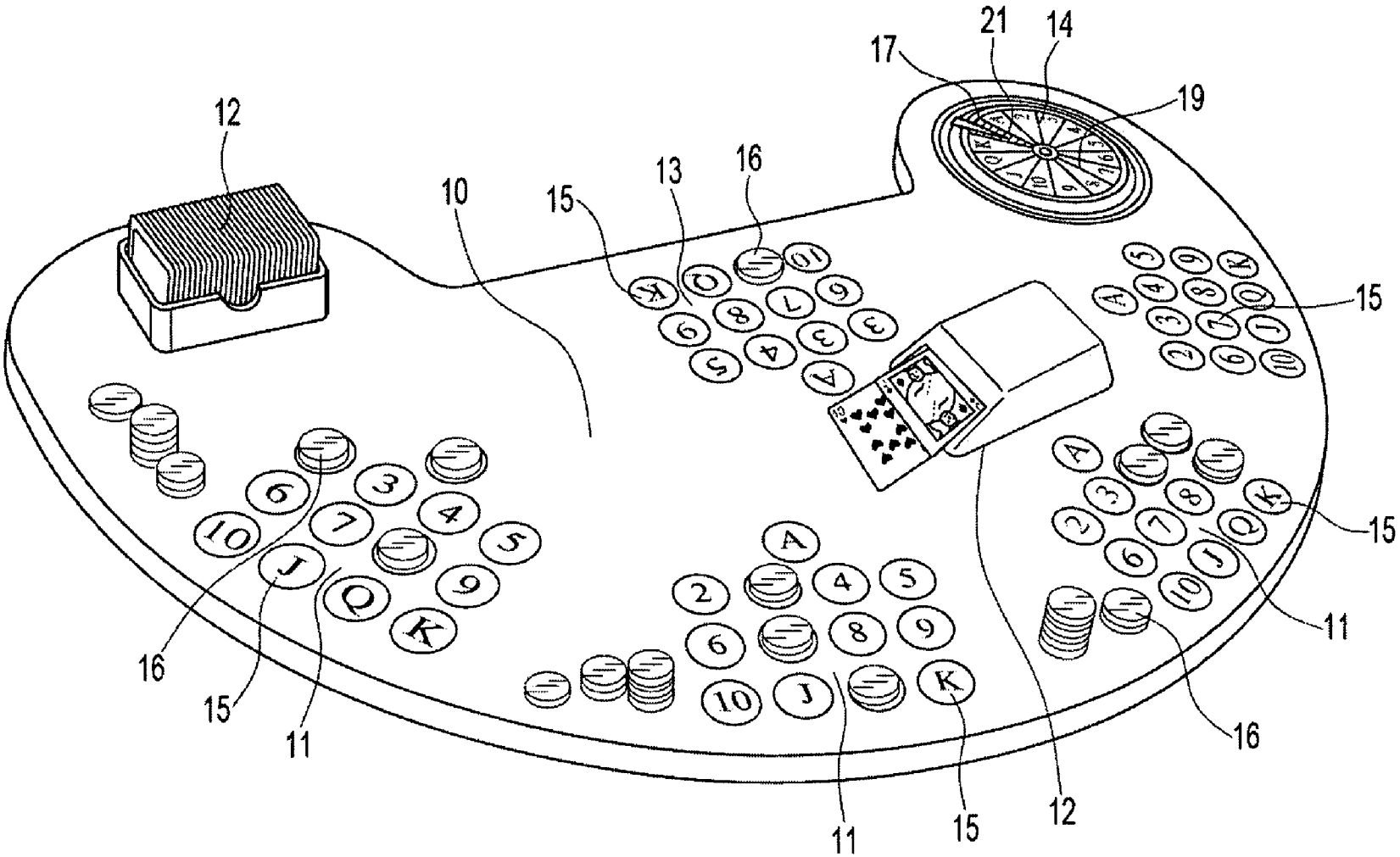
FIG. 1 is a perspective view of an exemplary embodiment of showing the marked playing surface, the one or more standard decks of playing cards, the spinning wheel, and the chips used in the card game of the present invention.

FIG. 1 is a perspective view showing exemplary embodiments of the marked playing surface, generally designated 10, including in this embodiment for example only four identical player grids 11 and one dealer grid 13, each player and dealer grid containing a total of thirteen chip positioning spaces 15; the one or more standard decks of playing cards, generally designated 12; the spinning wheel, generally designated 14, including in this example a spinnable pointer 17 and thirteen card designation sections 19; and the chips, generally designated 16.

The exemplary card game includes the steps of a) providing a marked playing surface 10, one or more standard decks of playing cards 12, a spinning wheel 14, and chips 16; the marked playing surface is provided with several identical player grids 11 and a dealer grid 13, each player and dealer grid 11,13 containing a total of thirteen chip positioning spaces 15, one chip positioning space 15 for each of the playing cards in each suit, (in this example, each grid 11,13 is arranged 4×3 array with a single space 15 centered at the top of the 4×3 array, each chip positioning space 15 being designated with a designation representing a playing card, such as for instance: A=ace, 1=one, 2=two, 3=three, 4=four, 5=five, 6=six, 7=seven, 8=eight, 9=nine, 10=ten, J=jack, Q=queen, and K=king); the spinning wheel 14 having a spinnable pointer 17 and thirteen card designation sections 19 each designated in no particular order with one of the card values of ace, 1, 2, 3, 4, 5, 6, 7, 8, 9, 10, Jack, Queen, and King; b) the one or more decks of playing cards 12 are shuffled and placed in a shuffled card stack; c) the dealer then spins the pointer 17 to determine the house card, the house card being designated by the pointer 17 when the end 21 of the pointer 17 lands on a particular card designation sections 19; d) the dealer then places a chip or other marker over the chip positioning space 15 for the house card on the dealer grid 15; e) each player then places a bet by selecting up to three separate card designation sections 15 in their designated player grid 11 by placing one or more chips over any chip positioning space 15 except the chip positioning space corresponding to the house card, all chips positioned by a player on his/her player grid 11 are considered to be bet; f) the dealer then pulls a match playing card from the shuffled card stack and turns the match playing card face up, the match playing card pulled is preferably selected by turning over the top card of the shuffled card stack; g) if the value of the match playing card corresponds to the house card, the house loses and pays each player an amount corresponding to the number of chips on that particular player's grid; if the value of the match playing card corresponds to a value selected by a player, the player loses any chips he/she may have placed on the corresponding chip positioning space 15 of his/her players grid 11; h) each player is then given an opportunity to increase his/her existing wagers, no new number may be selected; i) play of the hand continues until the match playing card equals the house card or no more chips 12 are positioned on any of the player grids 11; j) additional hands may be played by repeating steps c–g until fewer than a predetermined number of playing cards 12 remain in the shuffled card stack in which case, step b) is performed prior to performing step c) for that particular hand.

It can be seen from the preceding description that a card game has been provided.

It is noted that the embodiment of the card game described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A method for playing a card game that comprises the steps of:

a. providing a marked playing surface; one or more decks of playing cards; a house card determining device; and wagering chips;

the marked playing surface being provided with several identical player grids and a dealer grid, each player and dealer-grid containing a total of thirteen chip positioning spaces, one chip positioning space for each of the playing cards in each suit, that are arranged a 4×3 array with a single space centered at the top of the grid, each chip positioning space being designated with a designation representing a playing card;

the house card determining device having means for generating a random house card in response to being activated by the dealer;

b. shuffling the one or more decks of playing cards and then placing the shuffled cards into a stack;

c. obtaining a determination of the house card using the house card determining device;

d. having a dealer mark the dealer grid by pacing an item in the space on the dealer grid that corresponds with the house card;

e. having each player place wagers for the hand wherein each eager is indicated by a player placing one or more chips on any chip positioning space except the chip positioning space corresponding to the house card;

f. pulling a card from the shuffled deck and turning the card face up to determine a match card;

g. the house takes and pays wagers according to the following format: should the match card equal the house card, the house pays each player even money on every wager the player has on the grid; if the match card corresponds to a value selected by a player, the player loses any chips he/she may have placed on the corresponding chip positioning space of his/her players grid;

h. all players are then allowed to increase an existing wager, however, no new chip position spaces may be selected for wagering on;

i. another match card is determined and bets taken and paid until either the match card equals the house card, or the house has won every wager.

* * * * *